US007601069B2

(12) United States Patent
Freres

(10) Patent No.: US 7,601,069 B2
(45) Date of Patent: Oct. 13, 2009

(54) SANDBOX FORMED FROM INTERLOCKING PANELS

(76) Inventor: Christopher Freres, 1069 Zygmunt Cir., Westmont, IL (US) 60559

( * ) Notice: Subject to any disclaimer, the term of this patent is extended or adjusted under 35 U.S.C. 154(b) by 456 days.

(21) Appl. No.: 11/582,229

(22) Filed: Oct. 17, 2006

(65) Prior Publication Data

US 2008/0090668 A1 Apr. 17, 2008

(51) Int. Cl.
*A63G 31/00* (2006.01)
*A63H 33/32* (2006.01)

(52) U.S. Cl. ..... 472/126; 446/70; 446/106; 446/108

(58) Field of Classification Search ..... 472/126, 472/136, 137; 446/70, 85, 86, 108, 109, 446/114, 115, 122, 124, 125, 127; 108/25, 108/26

See application file for complete search history.

(56) References Cited

U.S. PATENT DOCUMENTS 3,067,903 A * 12/1962 Jones, Jr. ..... 220/552
3,952,941 A 4/1976 Zimmerman
3,962,734 A 6/1976 Chase
3,968,610 A 7/1976 Medow
3,975,874 A 8/1976 Witte et al.
4,045,019 A 8/1977 Wade
4,047,340 A 9/1977 Witte et al.
4,123,840 A 11/1978 Rumer
4,125,970 A 11/1978 Vidal
4,144,681 A 3/1979 Leffler et al.
4,324,178 A 4/1982 Barbour
4,346,885 A 8/1982 Mathou
4,515,360 A 5/1985 Mariol
4,566,520 A 1/1986 Sheboski
4,749,083 A 6/1988 Growney
4,762,315 A 8/1988 Witter
4,765,485 A 8/1988 Perkins
4,799,665 A 1/1989 Bracy
4,872,575 A 10/1989 Kobilan
4,901,998 A 2/1990 Griffith
5,014,570 A 5/1991 Fogerty, Jr.

(Continued)

*Primary Examiner*—Kien T Nguyen
(74) *Attorney, Agent, or Firm*—Wood, Phillips, Katz, Clark & Mortimer

(57) ABSTRACT

Panels for assembling a sandbox frame include an elongate A panel and an elongate B panel. Each panel has an end portion terminating in an end edge. The end edge is oriented transverse to the length dimension of the panel. A first cord receiving notch is disposed in the A panel end edge. A second cord receiving notch is disposed in the B panel end edge. A first elongate A slot is proximate the A panel end portion. The first slot is oriented transverse to the length dimension of the A panel. A second elongate B slot is proximate the B panel end portion. The second slot is oriented transverse to the length dimension of the B panel. A first groove is disposed in the A panel end portion. The first groove is oriented transverse to the A panel length dimension. The groove is recessed from a main surface of the A panel and defined by opposed groove walls wherein one of the groove walls is beveled. When the A and B panels are assembled, the A panel slot interlocks with the B panel slot. The A panel slot captures a B panel wall portion adjacent the B panel slot. The B panel slot captures an A panel wall portion adjacent the A panel slot. The A panel end portion and the B panel end portion intersect.

22 Claims, 14 Drawing Sheets

U.S. PATENT DOCUMENTS 5,052,580 A * 10/1991 Khoury ..... 220/505
5,086,602 A 2/1992 Pukas
5,205,791 A 4/1993 Pledger
5,326,328 A 7/1994 Robinson
5,342,083 A 8/1994 Gentile et al.
5,423,463 A * 6/1995 Weeks ..... 224/42.33
5,488,808 A 2/1996 Cahill et al.
5,590,824 A * 1/1997 Weeks ..... 224/42.33
5,928,086 A 7/1999 Strickland
5,957,289 A 9/1999 Negelen
6,174,116 B1 * 1/2001 Brand ..... 410/140
6,331,147 B1 12/2001 Munro et al.
6,843,284 B2 1/2005 Morin
7,025,199 B1 4/2006 Lim
2002/0020011 A1 2/2002 Arout et al.
2003/0079395 A1 5/2003 Chong
2004/0139680 A1 7/2004 Hambright
2004/0217155 A1 11/2004 Abshire et al.
2005/0102948 A1 5/2005 Zahner, III
2006/0065706 A1 3/2006 Ranen

* cited by examiner 20
66
IV
L
46
54
91
92
B2
84
PLAY SAND
106
III
A2
62
52
42
50
56
44
II
64
106
116
108
110
A1
48
56
40
B1
150
112
90
108
I
60

IV
L
23
31
46
106
70
74
100a
II
104
100b
B2
56
114
III
32
92
96a
84
27
A2
42
102
96b
54
70
30
24
35
44
80
22
56
110
108
106
28
112
26
52
80
A1
108
116
40
56
56
36
25
B1
34
20
33
I
48
106
114
108
56
37
29
108

SANDBOX FORMED FROM INTERLOCKING PANELS

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to frames formed from interlocking panels, and, more particularly, to a sandbox formed from interlocking panels.

2. Description of the Background of the Invention

Various patents disclose sandboxes and/or interlocking panels.

Pledge U.S. Pat. No. 5,205,791 discloses a collapsible sheet having a drawstring and peripheral vertical wall portions. The sheet forms a sandbox in an uncollapsed state.

Strickland U.S. Pat. No. 5,928,086 discloses a sandbox that may be adjusted to different heights.

Munro et al. U.S. Pat. No. 6,331,147 discloses a sandbox having a cover. The sandbox includes vertical posts, and the cover may be mounted on the posts in spaced relation to the sandbox such that the cover may optionally form a roof.

Weeks U.S. Pat. No. 5,423,463 and Brand U.S. Pat. No. 6,174,116 disclose interlocking divider panels, which divide a cargo space into desired size compartments. The panels have opposed slots that interlock.

Reisman U.S. Pat. No. 5,292,197 discloses cardboard interlocking filler panels wherein the panels have opposed slots. The interlocked cardboard panels may be used to stuff a backpack, purse, or other similar item for display purposes.

SUMMARY OF THE INVENTION

In accordance with one aspect of the present invention, panels for assembling a sandbox frame include an elongate A panel and an elongate B panel. Each panel has an end portion terminating in an end edge. The end edge is oriented transverse to the length dimension of the panel. A first cord receiving notch is disposed in the A panel end edge. A second cord receiving notch is disposed in the B panel end edge. A first elongate A slot is located proximate the A panel end portion and is oriented transverse to the length dimension of the A panel. A second elongate B slot is located proximate the B panel end portion and is oriented transverse to the length dimension of the B panel. A first groove is disposed in the A panel end portion. The first groove is oriented transverse to the A panel length dimension. The groove is recessed from a main surface of the A panel and defined by opposed groove walls wherein one of the groove walls is beveled. When the A and B panels are assembled, the A panel slot interlocks with the B panel slot. The A panel slot captures a B panel wall portion adjacent the B panel slot. The B panel slot captures an A panel wall portion adjacent the A panel slot. The A panel end portion and the B panel end portion intersect.

In accordance with a further aspect of the present invention, an assembled sandbox frame assembled from elongate interlocked slotted panels includes (1) an A1 panel and an A2 panel and a B1 panel and a B2 panel, (2) first and second A1 panel ends and first and second A2 panel ends, (3) first and second B1 panel ends and first and second B2 panel ends wherein each of the A and B panel ends includes a tarp cord receiving notch. A first corner is defined by the first A1 panel end intersecting the first B1 panel end. A second corner is defined by the second A1 panel end intersecting the first B2 panel end. A third corner is defined by the first A2 panel end intersecting the second B1 panel end. A fourth corner is defined by the second A2 panel end intersecting the second B2 panel end. A first A1 slot is disposed proximate the first A1 panel end. The first A1 slot faces a first direction transverse to the long axis of the A1 panel. A first B1 slot is disposed proximate the first B1 panel end. The first B1 slot is interlocked with the first A1 slot. The first B1 slot faces a second direction opposite to the first direction. A first wall portion of the B1 panel is captured within the first A1 slot, and a second wall portion of the A1 panel is captured within the first B1 slot. The first wall portion includes a first groove defined by a first surface recessed from a main B1 panel surface and is disposed between first and second opposed walls. At least the first wall is beveled. The second wall portion includes a second groove defined by a second surface recessed from a main A1 panel surface and disposed between third and fourth opposed walls. At least the third wall is beveled. The first beveled wall is in contact with the third beveled wall. A second A1 slot is interlocked with a first B2 slot of the B2 panel. A first A2 slot is interlocked with a second B2 slot of the B2 panel. A second A2 slot is interlocked with a second B1 slot of the B1 panel.

BRIEF DESCRIPTION OF THE DRAWINGS

FIG. 3A-2 is an enlarged view of FIG. 3A;

FIG. 7-1A is an isometric view of the sandbox of FIG. 1 further including corner seats;

FIG. 7-1B is an isometric view showing a bench seat;

FIG. 7-2 is an enlarged isometric view of the sandbox of FIG. 1 showing seats placed on the sand in the middle of the sandbox;

DETAILED DESCRIPTION OF THE PREFERRED EMBODIMENTS

Figure 1:
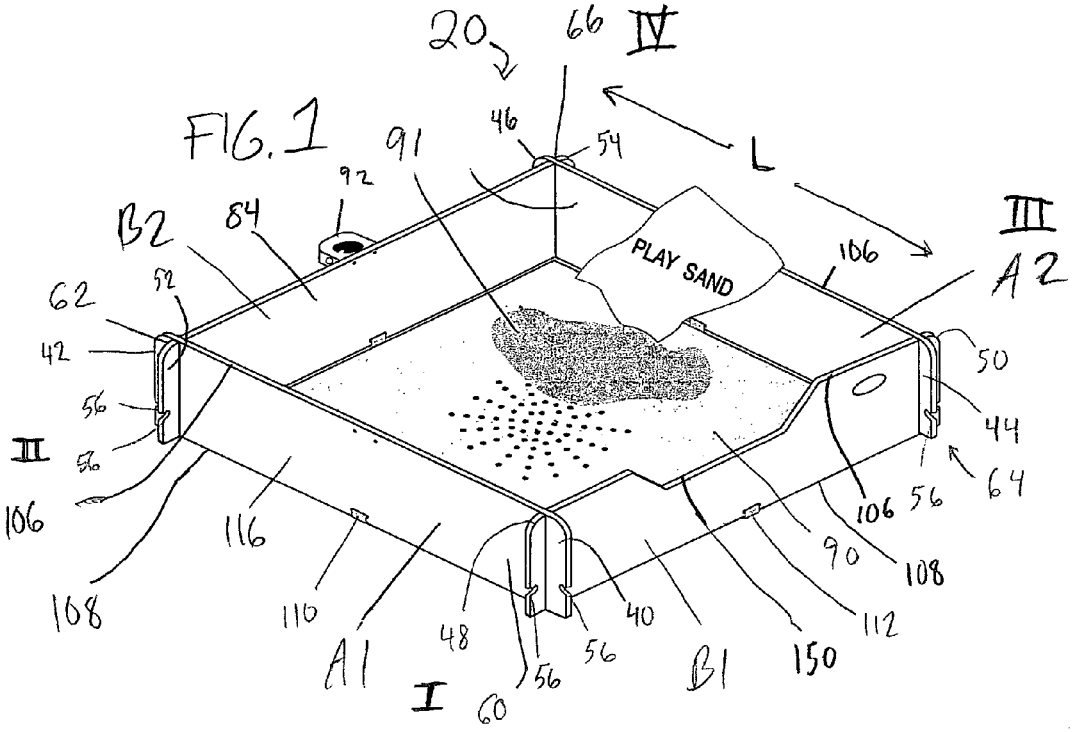
FIG. 1 is an isometric view showing a sandbox having a liner and a bag of play sand emptying sand onto the liner.
Figure 2:
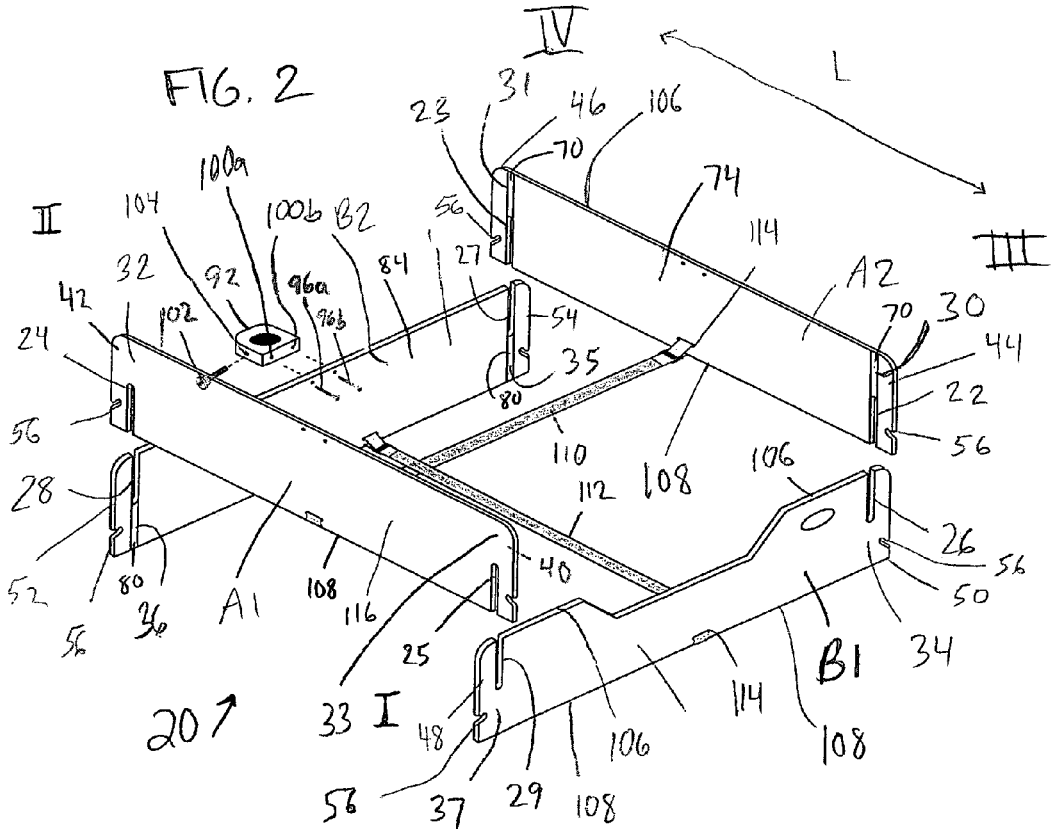
FIG. 2 is an exploded isometric view of the sandbox of FIG. 1 with the liner removed, thereby exposing straps.

Referring to FIG. 1, a sand box or frame 20 includes elongate A panels A1 and A2 and elongate B panels B1 and B2. The panels may be of any suitable material such as high or low density polyethylene or high or low density polypropylene. Referring to FIG. 2, the A panels include elongate A slots 22-25, and the B panels include elongate B slots 26-29. The A and B panels include a length dimension L. The A slots 22-25 interlock with the B slots 26-29 to assemble the sandbox 20. It should be noted that when the box 20 is assembled, the A slots 22-25 face one direction and the B slots 26-29 face an opposite direction. The A and B slots are preferably oriented transverse to the length dimension L of the panels, and are shown as oriented perpendicularly to the length dimension L. The A panels, as shown, may be described as slots down panels, while the B panels as shown may be described as slots up panels. The A and B slots may be U-shaped. As used herein, "transverse" to the length dimension L means at any angle to the length dimension L. Wall portions 30-33 of the A panels are captured within the B slots, and wall portions 34-37 of the B panels are captured within the A slots 22-25. For example, the wall portion 31 is shown in greater detail in FIGS. 3A-2 and 5 and discussed hereinbelow.

Figure 8:
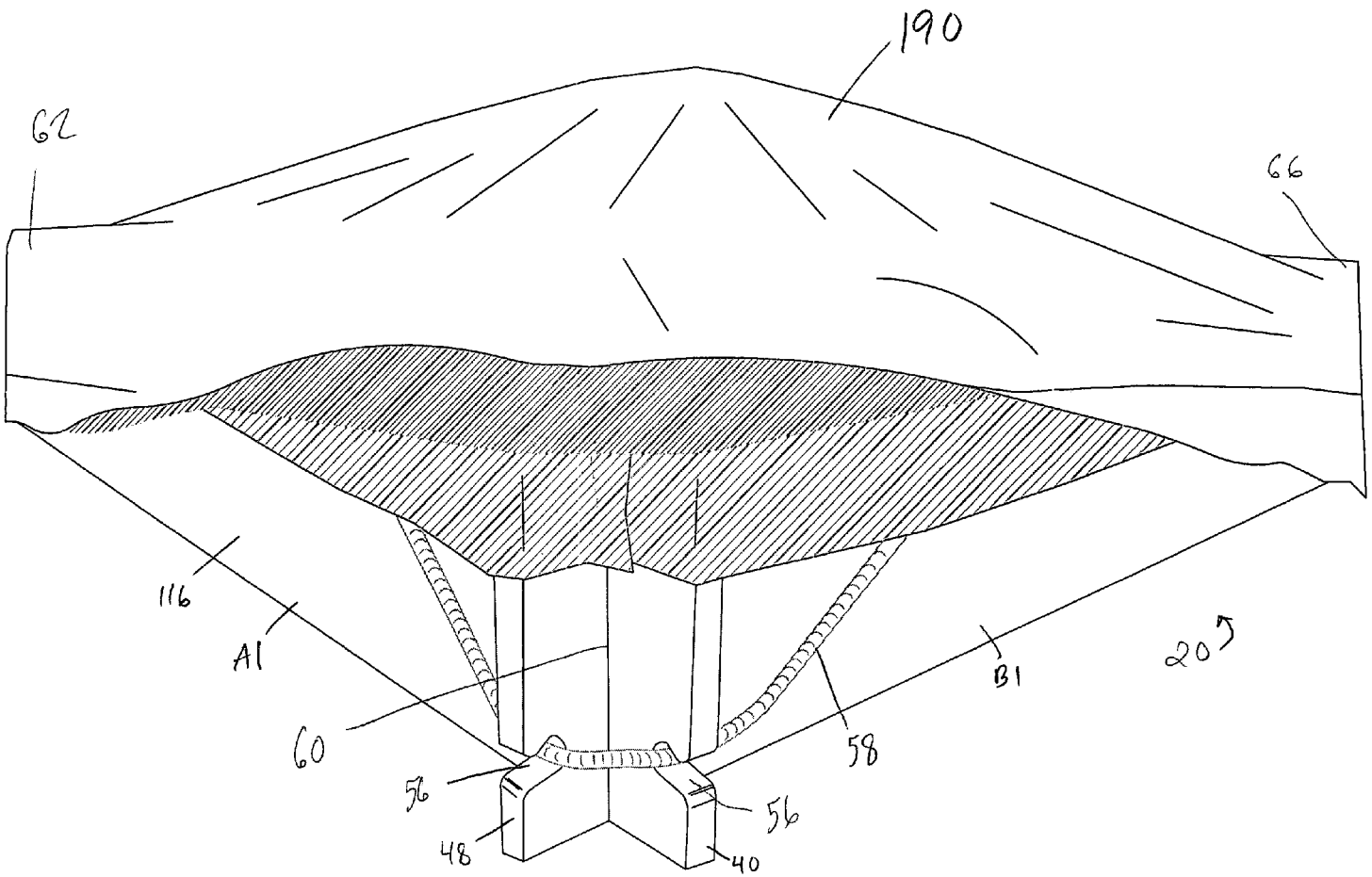
FIG. 8 is an enlarged isometric view of the sandbox of FIG. 1 showing a tarp that covers the sandbox wherein a portion of the tarp is folded back to reveal a strap or cord used to secure the tarp tightly to the sandbox.

Referring to FIG. 2, the A1 panel includes first and second ends 40, 42. The A2 panel includes first and second ends 44, 46. The B1 panel includes first and second ends 48, 50. The B2 panel includes first and second ends 52, 54. Each of the ends 40, 42, 44, 46, 48, 50, 52, 54 includes a lobe-shaped notch 56 for receipt of a tarp cord 58 (FIG. 8).

Referring to FIG. 1, first through fourth corners are identified by roman numerals I-IV. A first corner 60 is defined by the first A1 panel end 40 intersecting the first B1 panel end 48. A second corner 62 is defined by the second A1 panel end 42 intersecting the first B2 panel end 52. A third corner 64 is defined by the first A2 panel end 44 intersecting the second B1 panel end 50. A fourth corner 66 is defined by the second A2 panel end 46 intersecting the second B2 panel end 54.

Figure 3A:
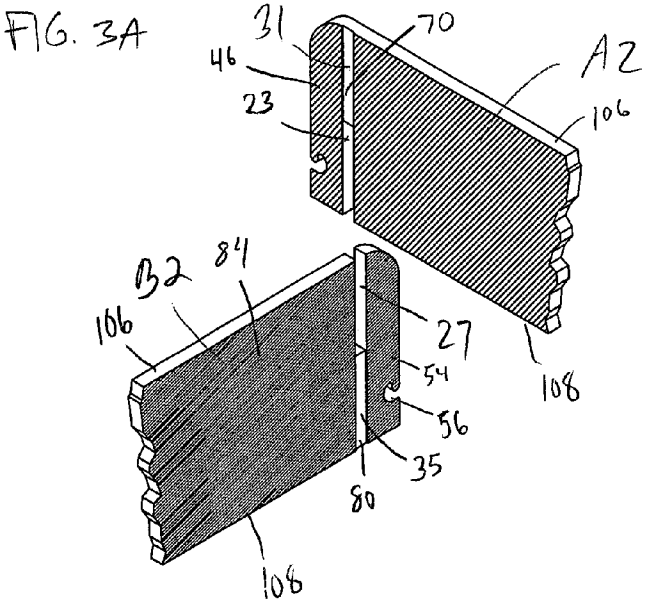
FIG. 3A is an enlarged fragmentary isometric view showing end portions of interlocking panels in a separated, non-engaged position.
Figure 3B:
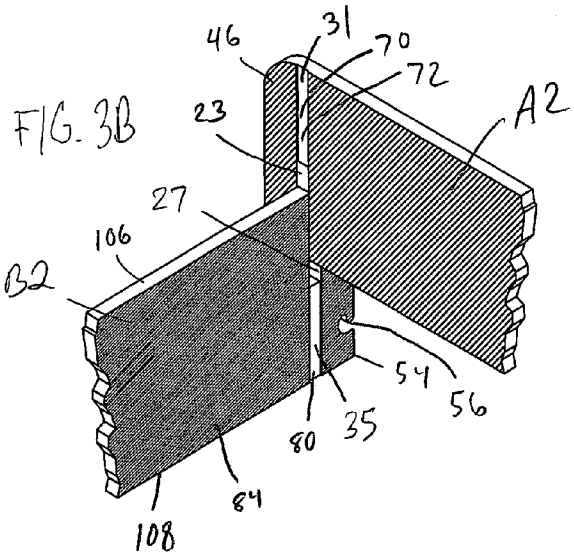
FIGS. 3B and 3C show the panels in interlocked positions.
Figure 3C:
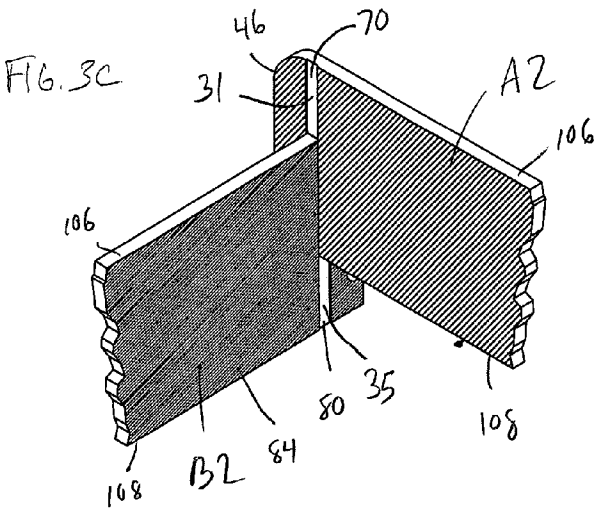
Figure 3D:
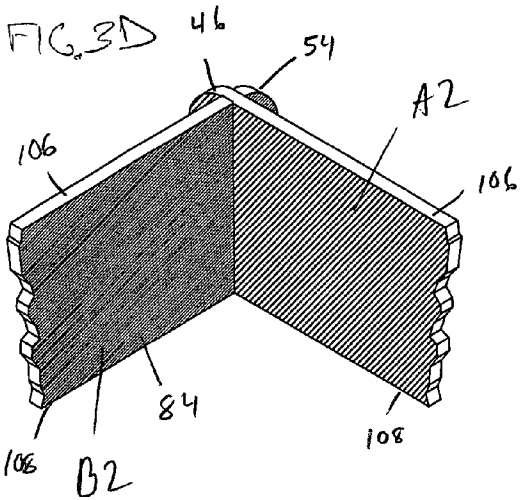
FIG. 3D shows the panel in a final interlocked position.
Figures 2, 34:
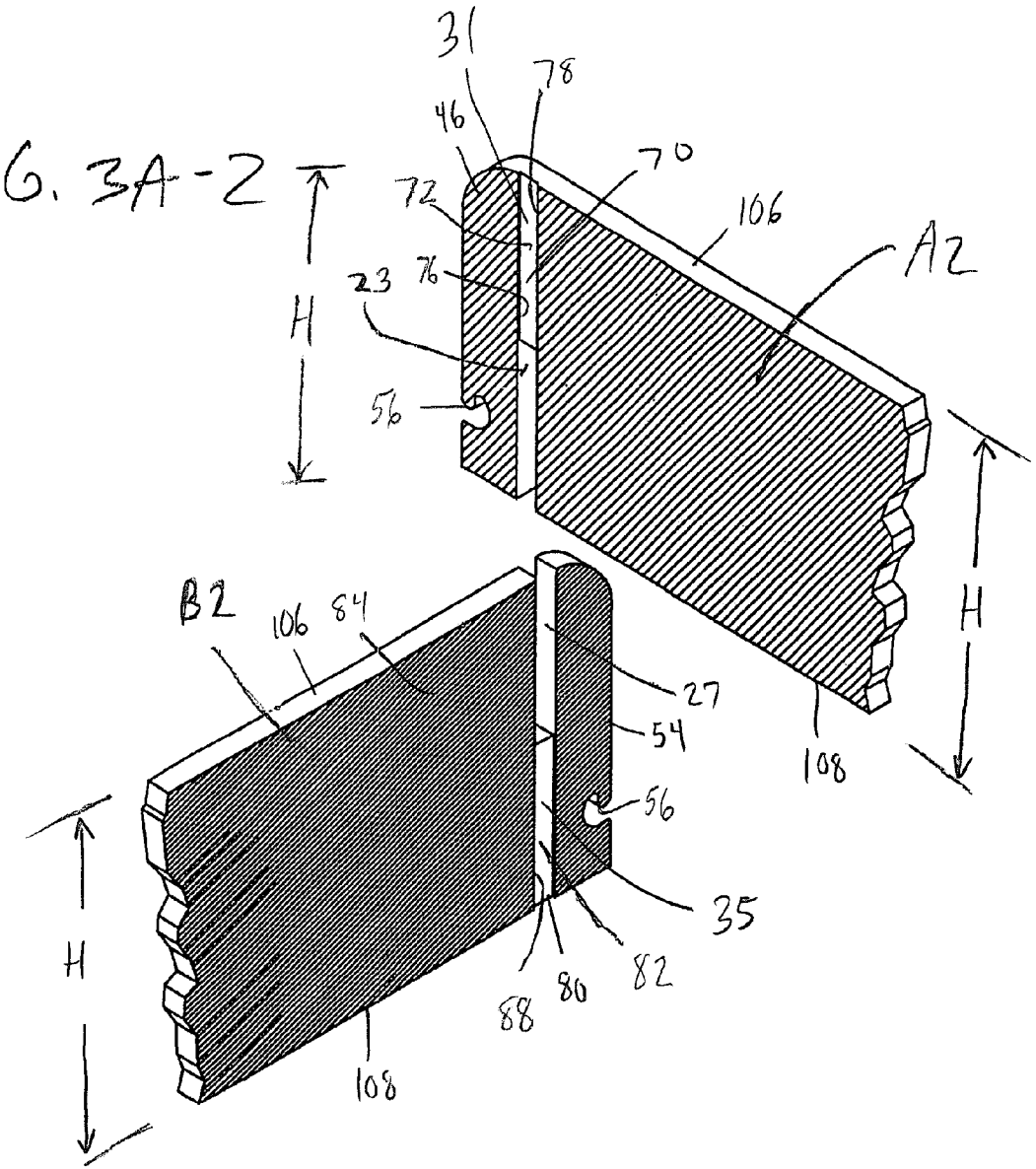
Figure 4:
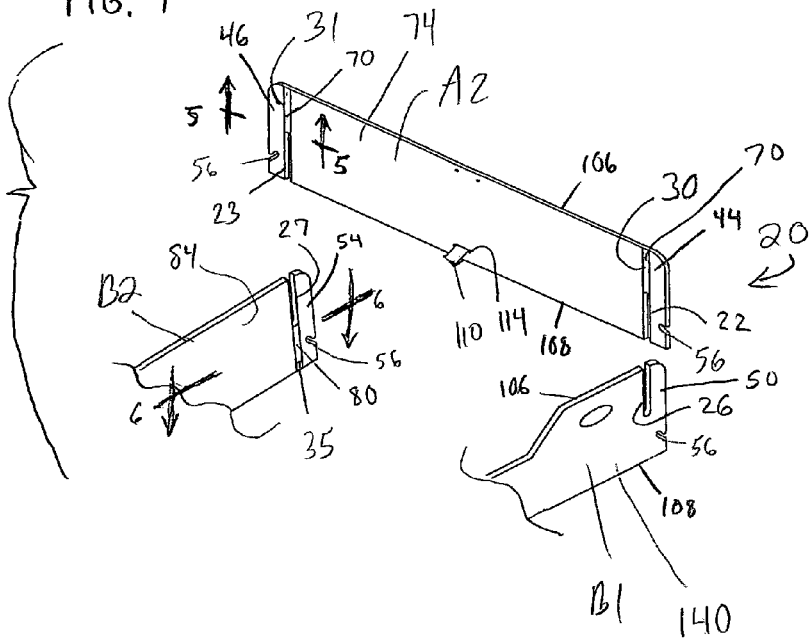
FIG. 4 is a fragmentary exploded isometric view of panels shown in FIGS. 1 and 2.
Figure 5:
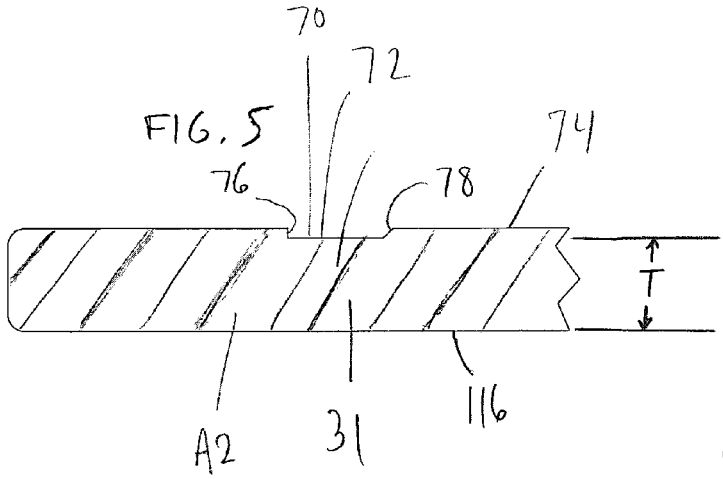
FIG. 5 is an enlarged sectional view taken along the lines 5-5 of FIG. 4.
Figure 6:
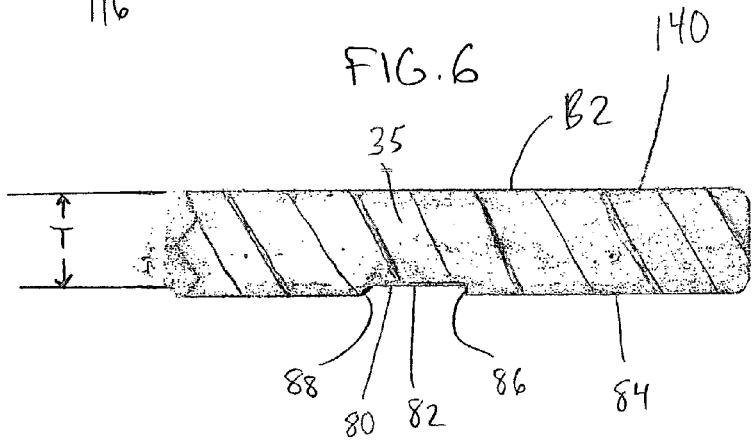
FIG. 6 is an enlarged sectional view taken along the lines 6-6 of FIG. 4.

Referring to FIGS. 4 and 5, the wall portion 31, which may be similar or identical to the other captured A wall portions 30, 32, 33, includes a groove 70 defined by a surface 72 recessed from a main panel surface 74 of the A2 panel and disposed between opposed walls 76, 78. The wall 78 is beveled. Referring to FIG. 6, the wall portion 35, which may be similar or identical to the other captured B wall portions 34, 36, 37, includes a groove 80 defined by a surface 82 recessed from a main interior panel surface 84 of the B2 panel and disposed between opposed walls 86, 88. The wall 88 is beveled. Referring to FIG. 3A-2, when the A and B panels are assembled, the beveled wall 78 slides along the beveled wall 88 until the A and B panels are in the final fully interlocked position shown in FIG. 3D.

Referring to FIGS. 3A-3D, interlocking the A and B panels is accomplished by aligning the longitudinal axis of the A slot with the longitudinal axis of the corresponding B slot and then moving the A panel toward the B panel to the position shown in FIG. 3D. Referring to FIG. 3A-2, the beveled wall 78 extends along, and is beveled along, an entire height dimension H of the A2 panel. Likewise the beveled wall 88 extends along, and is beveled along the entire height dimension of the B2 panel.

Referring to FIG. 1, the sandbox 20 may include a bottom panel or liner 90 onto which sand 91 may be disposed. The liner 90 may be of any suitable flexible material such as flexible low density polyethylene LDPE, so that the liner 90 may be rolled up, if desired, for ease of shipping. Referring also to FIG. 2, the sandbox 20 may optionally include an umbrella holder 92 that may be secured to any one of the A or B panels by fasteners such as screws 96*a*, 96*b*, disposed through pre-formed bores in the B2 panel, the screws 96 threaded into threaded bores 100*a*, 100*b* of the umbrella holder 92. A set screw 102 may be threaded into or out of a threaded through-hole 104 to tighten or loosen the set screw 102 against a shaft of an umbrella (not shown) for adjustable positioning of the umbrella within the umbrella holder 92. It should be apparent to one of ordinary skill in the art that the any of bores in the B2 panel or in the umbrella holder 92 may be counter-bores as desired for stopping the heads of the screws 96 or 102.

Referring to FIG. 2, when the sandbox 20 is assembled outdoors, the A and B panels have a non-support longitudinal edge 106 that faces the sky and an opposite longitudinal edge or support edge 108, facing the ground. The B slots 26-29 are formed by cutting the B panels in a direction from the non-support edge 106 toward the support edge 108. In contrast, the A slots 22-25 are formed by cutting the A panels from the support edge 108 toward the non-support edge 106. It should be noted that if one assembled the sandbox 20 in an indoor environment one could refer to the edges 106, 108 as ceiling facing or floor facing, respectively. The sandbox 20 may include any suitable reinforcing straps 110, 112. When the sandbox 20 is filled with sand, the straps 110, 112 resist load-bearing forces of the sand that tend to push the A1 panel away from the A2 panel and the B1 panel away from the B2 panel. The straps 110, 112 are preferably looped through suitable through-holes 114. The straps 110, 112 are preferably adjustable so that an end user may manually tighten the straps 110, 112, perhaps with a suitable buckle, once the panels are interlocked in a fully assembled position. The straps 110, 112 may be generally available heavy duty polypropylene straps.

Referring to FIGS. 3A-3D and 3A-2, when the A and B panels are interlocked, the beveled walls 78 of the A panels engage the beveled walls 88 of the B panels. The beveled walls 78 of the A panels slide along the beveled walls 88 of the B panels until the A and B panels are fully interlocked. Including the beveled walls 78, 88 is a preferred design feature in that the beveled walls 78, 88 may facilitate sliding the A slot along the B slot and the A wall portions 30-33 into the B slots 26-29 and the B wall portions 34-37 in the A slots. It is believed that if one fashioned all of the opposed surfaces 76, 78 and 86, 88 at ninety degrees relative to the recessed surfaces 72 and 82, respectively, that it could be more difficult to manually slide the wall portions into the slots. It is believed that if one fashioned all of the surfaces 76, 78, 86, 88 at ninety degrees, this could potentially require more precise alignment of the slots and/or potentially more force to interlock the panels than if one employed the beveled surfaces 78, 88.

It should be noted that a fairly rigid and strong interlocking of the A panels with the B panels may be desired. In this regard, when forces are exerted on the A and B panels, excessive wobbling or flexion of one or more the panels relative to other panels may be undesirable. Such wobbling may be minimized by cutting the A and B slots and the grooves 70, 80 to desired sufficiently tight fitting dimensions during manufacture of the panels. Cutting the A and B slots and grooves 70, 80 is believed to be a better method of dimensioning than if one were to use some form of molding/extrusion method to form the A and B slots and the grooves 70, 80. For example, referring to FIG. 5, the wall portion 31 needs to have a thickness T corresponding to fit securely within the slot 23. If thickness T is too large, the wall portion 31 will be difficult to fit within the slot 23, or perhaps impossible. If thickness T is too small, the resulting interlocking fit may be too loose, potentially causing undesired panel wobbling. Attempting to control thickness T with an extrusion method could be difficult and/or costly because thickness T needs to be controlled within a suitably narrow tolerance range. For at least this reason, the present inventor has found that cutting the grooves 70, 80 is a simple and highly cost-effective method of achieving a good interlocking fit of the panels without the need for designing potentially difficult or costly extrusion.

The A and B slots may be sized slightly larger than thickness T to facilitate panel interlocking. For example, the thickness T may be set at 0.68 inches and the A and B slots at 0.7 inches using a conventional router or other suitable cutting apparatus.

Referring to FIGS. 2 and 4, it should be noted that when the sandbox 20 is assembled, the grooves 70, 80 face the interior of the sandbox 20. FIG. 4 shows that there is no groove in an exterior surface 140 of the B1 panel. This design feature can also be observed in FIGS. 5 and 6. FIG. 5 shows that the groove 70 is disposed on the interior facing surface 74, while there is no groove on an exterior facing surface 116.

Figures 1A, 1B, 7:
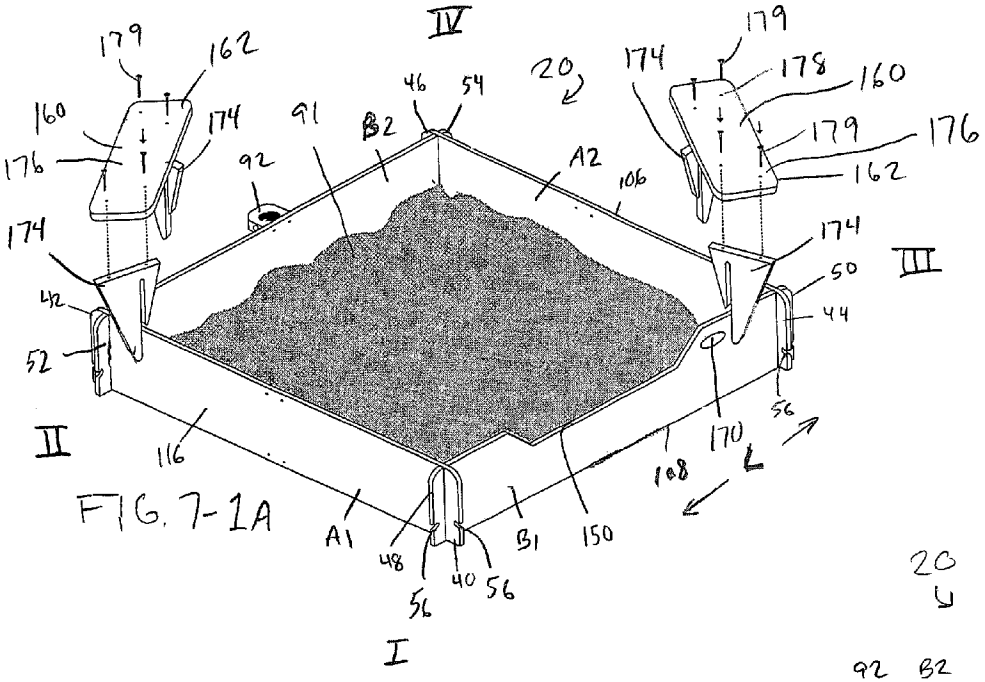
Figures 2, 7:
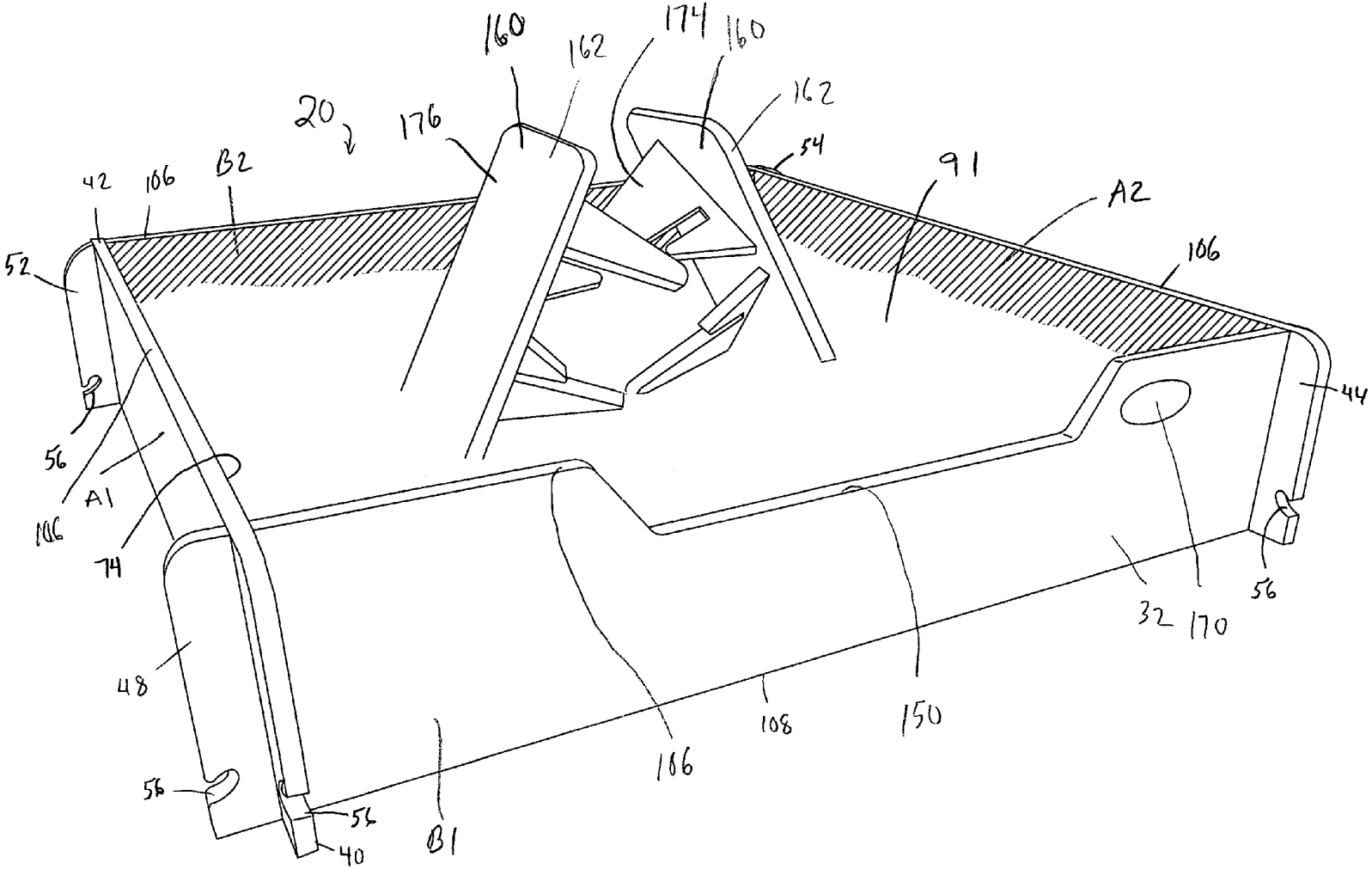

Referring to FIG. 7-1, one of the A or B panels may include a recessed surface 150, recessed from the non-support edge 106. The recessed surface 150, shown on the B1 panel, lowers the step-in height, thereby facilitating a child stepping or crawling into or out of the sandbox 20. The B1 panel may be referred to as a drop-down panel. The sandbox 20 may also include one or more seats 160, such as corner seats 162. FIG. 7-2 shows that the seats 160 may be readily removable from the panels. Any of the panels may include a suitable commercial logo at the position of 170 or any other suitable position.

Figure 13A:
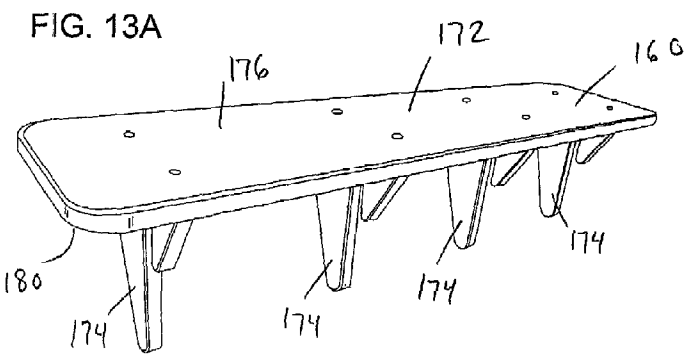
FIG. 13A is an isometric view of a bench seat.
Figure 13B:
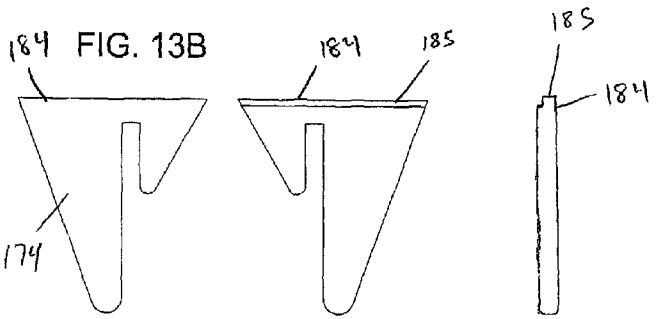
FIGS. 13B show opposite side elevational views of seat gussets and an end elevational view of a seat gusset for the bench seat.
Figure 13C:
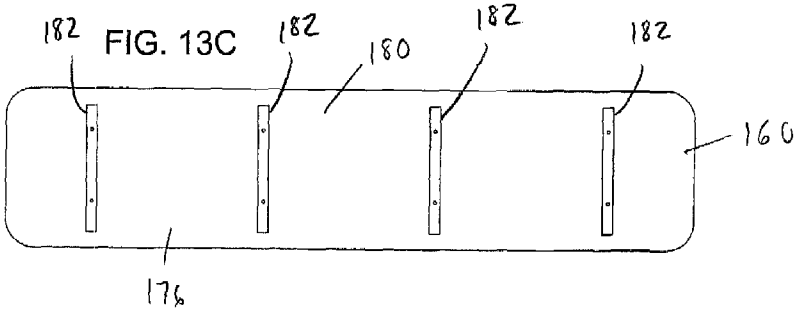
FIG. 13C is a bottom elevational view of the bench seat, with the gussets removed.
Figure 12A:
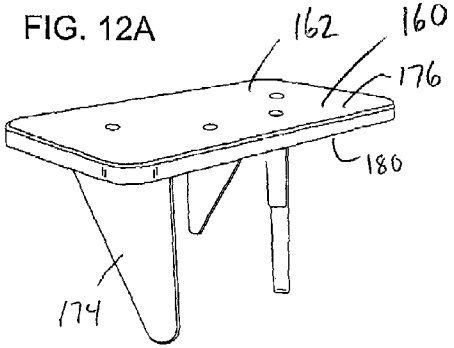
FIG. 12A is an isometric view of a corner seat.
Figure 12B:
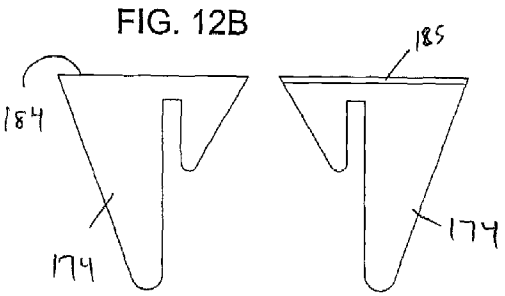
FIGS. 12B show opposite side elevational views of the seat gussets.
Figure 12C:
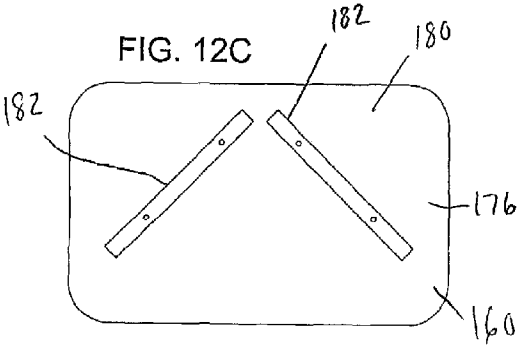
FIG. 12C is a bottom elevational view of the corner seat, with the gussets removed.

Referring to FIG. 7-1B, any of the seats 160 could be bench seats 172. The seats 160 include slotted gusset members 174, and slots of the gusset members 174 capture portions of an A or B panel therewithin to retain the seat 160 on the panel. A generally planar seat member 176 includes suitable through holes 178 through which allen screws 179 or other suitable fasteners may be disposed to secure the gusset members 174 to the seat member 176. The gusset members 174 may include suitably positioned pre-formed bores for receipt of the screws 179. Referring to FIGS. 12A-C and 13A-C, an underside 180 of the seat members 176 may include recesses 182 for receipt of the gusset members 174. Referring particularly to FIG. 13B, a head 184 of the gusset member may be cut to define a narrowed tip 185 sized to fit within the recess 182. In this regard, if a sandbox designer receives gusset members and seat members lacking the recesses 182 and tips 185, the designer may cut tips and recesses to any desired sizes or dimensions for easy fitting of the tips 185 into the recesses 182.

Referring to FIG. 8, a tarp 190 may be used to cover the sandbox 20 when not in use. Referring again to FIG. 7-2, placement of the seats 160 into the center of the box 20 elevates the tarp 190, thereby facilitating run-off of any rainwater. The seats 160 may be placed with the gusset members 174 facing each other. Promoting rainwater run-off is advantageous because retention of stagnant water is undesirable for a variety of reasons. It is also desirable to secure the tarp 172 tightly to the sandbox 20 to minimize the possibility of non-human animals, such as squirrels and raccoons, from accessing the sandbox 20 and potentially depositing fecal matter or urine onto the sand 91. In addition, a tight fit tends to minimize depressions in the tarp 190 that could potentially hold stagnant water. A tight fit is accomplished securing the tarp 190 with the elastic cord 58 that fits within the pairs of notches 56 at each corner 60, 62, 64, 66 of the sandbox 20. Each notch 56 is defined by opposed notch walls, one or both of the notch walls preferably extending at some angle to the length dimension of the panels. This may be preferable to having the notches 56 defined by opposed walls that are both parallel to the panel length dimension. For example, the notch walls may be curved. Such a configuration promotes retention of the tarp cord within the notches 56. The notches 56 are preferably lobe-shaped to promote retention of the cord 58 therein. Because each corner of the sandbox 20 provides a pair of spaced apart notches 56, there are more points of spaced apart attachment for the cord 58, than if one provided only a single point of attachment at each corner. Therefore, providing dual points of attachment at each corner provides for stronger attachment of the tarp 190 and also spreads the tarp 190 out.

Assembling the sandbox 20 involves (1) interlocking the A and B panels, (2) tightening the frame straps, perhaps with a suitable buckle, (3) placing the liner 90 over the straps, (4) placing sand in the box 20, (5) positioning the seat gusset members 174 into the recesses 182 of the seats 160, (6) fastening the gusset members 174 to the seat members 176 with a tool such as an allen wrench, and (7) placing the seats 160 onto one or more panels. Storing the sandbox 20 involves (1) positioning at least two seats 160 atop the sand 91 with the seat gusset members 174 of each seat facing each other, (2) stretching the tarp 190 over the seats, and (3) securing the tarp cord 58 within the notches 56.

Figure 9:
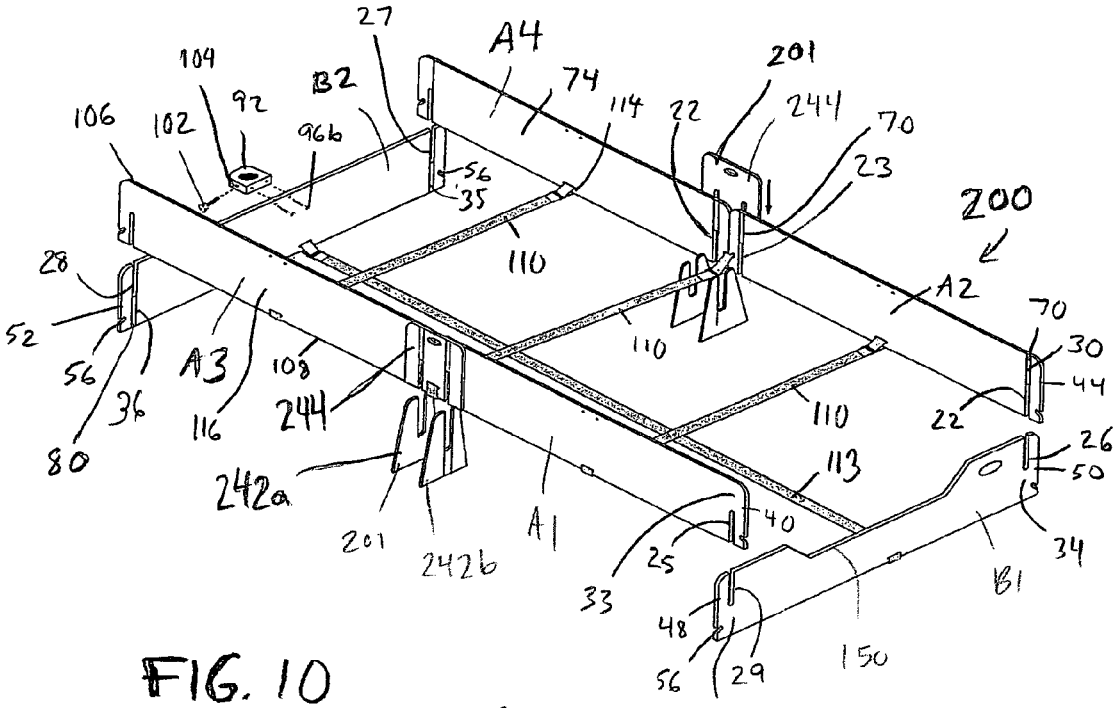
FIG. 9 is an exploded isometric view of an alternative elongate sandbox having coupling apparatus.
Figure 10:
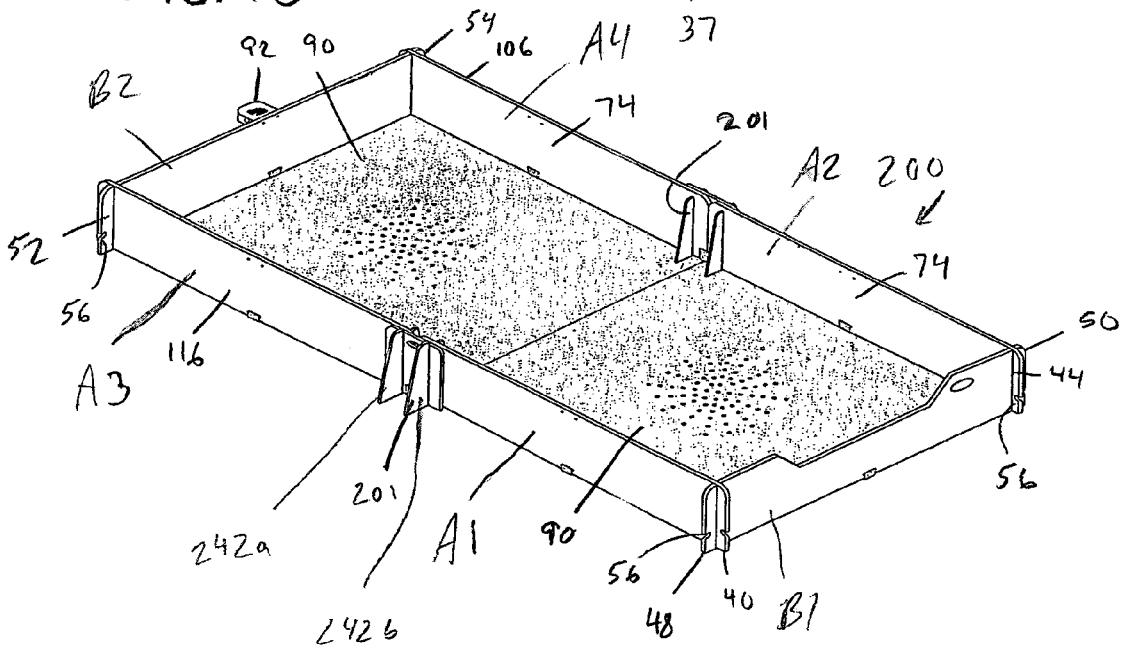
FIG. 10 is an isometric view of the sandbox of FIG. 9 shown in an assembled condition.

FIGS. 9 and 10 show an alternative elongate sandbox 200. The sandbox 200 is assembled by incorporating additional A panels A3, A4, which may be identical to the other A panels. The additional A3, A4 panels are coupled to the A1, A2 panels by coupling apparatus 201. An elongate strap 113, longer than the strap 112 (FIG. 2), may be employed.

Figure 11A:
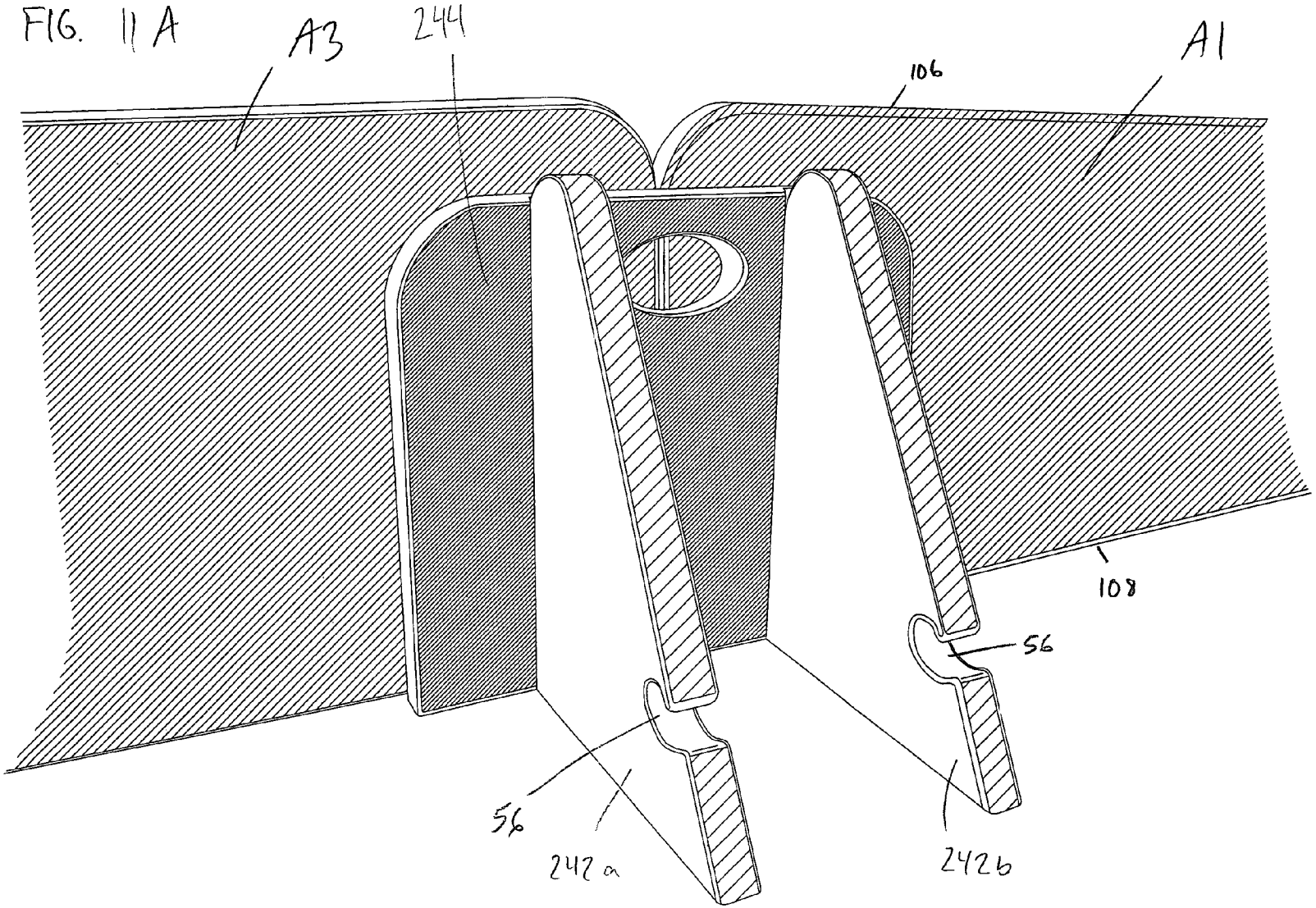
FIG. 11A is an enlarged fragmentary isometric view showing coupling apparatus of FIGS. 9 and 10.
Figure 11B:
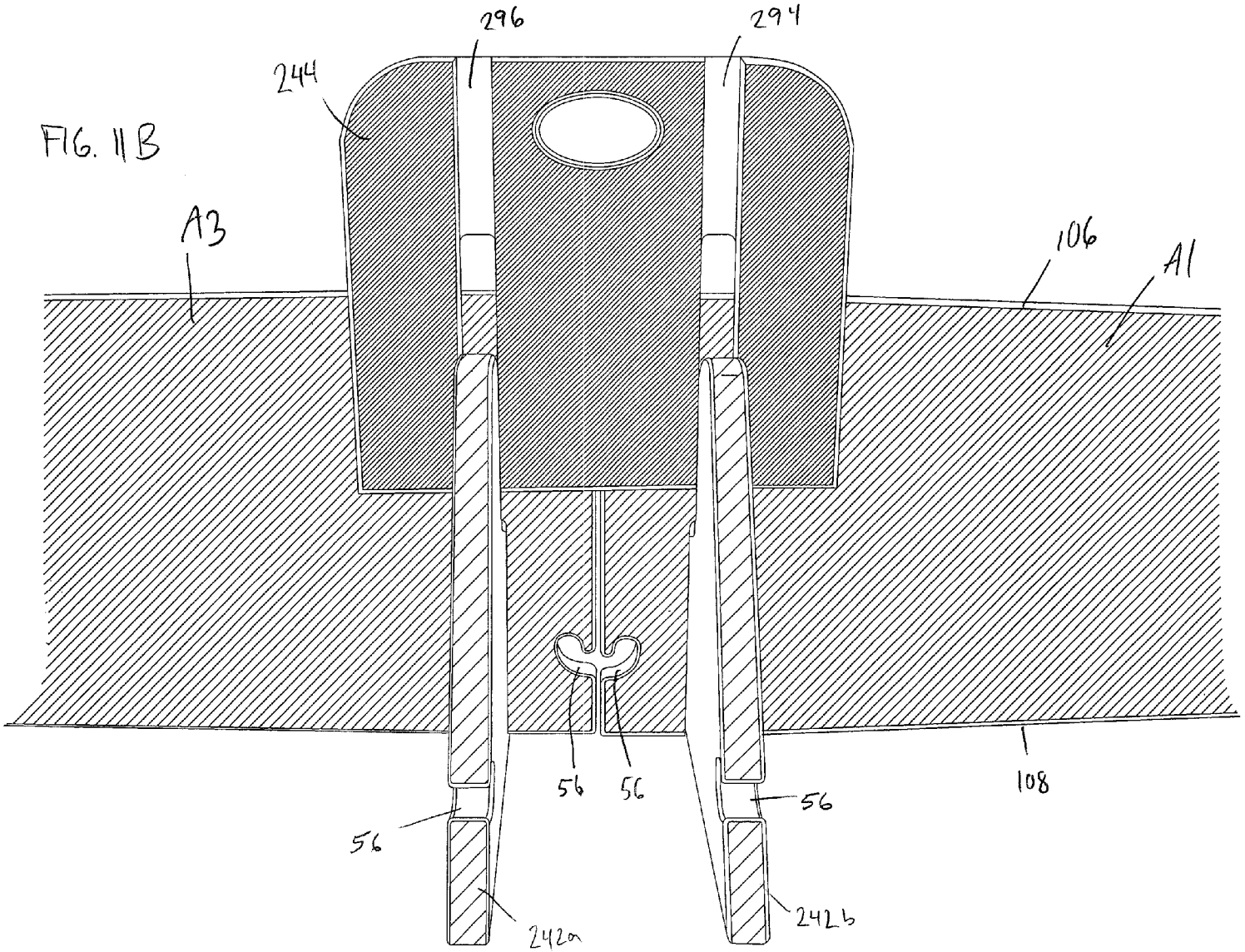
FIG. 11B is similar to FIG. 11A, but shows a coupler plate in a partially removed condition.
Figure 11C:
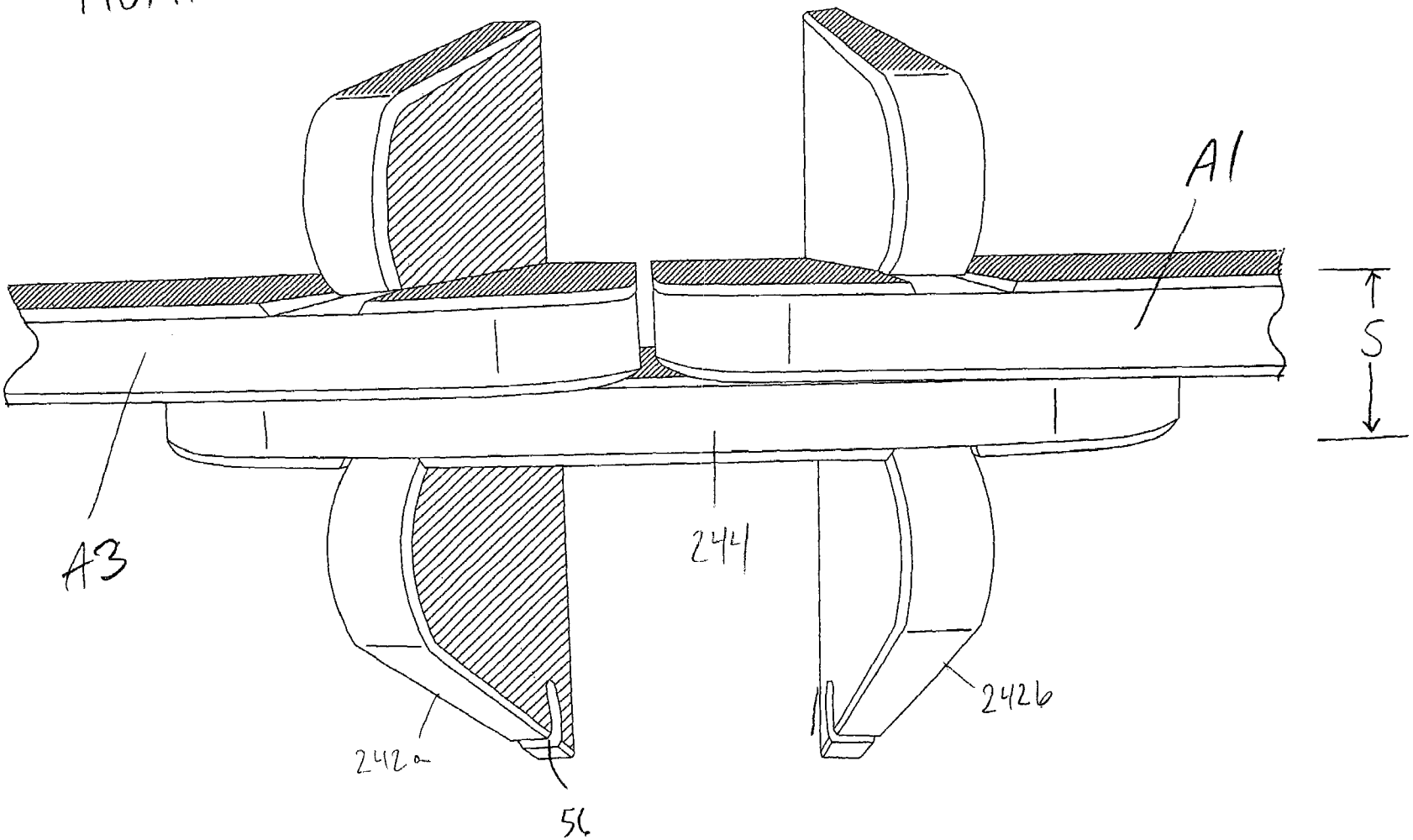
FIG. 11C is a view similar to FIGS. 11A and 10, but looking down from above on the coupling supports, coupler plate, and sandbox panels.
Figure 14B:
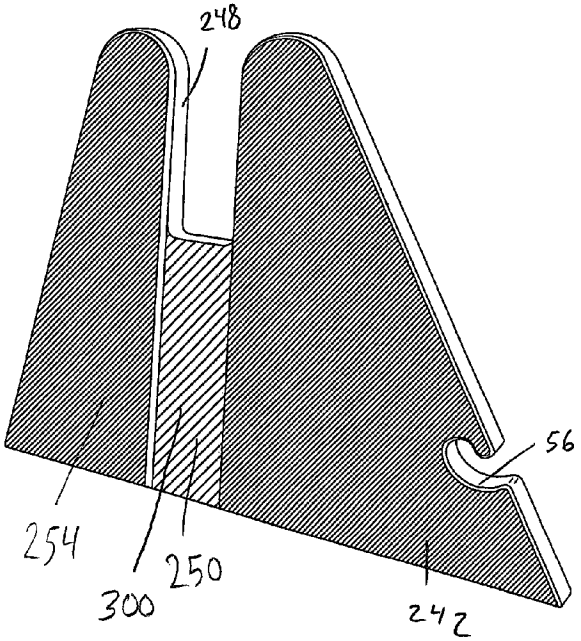
FIGS. 14A and 14B are isometric views of a coupling support.
Figure 14A:
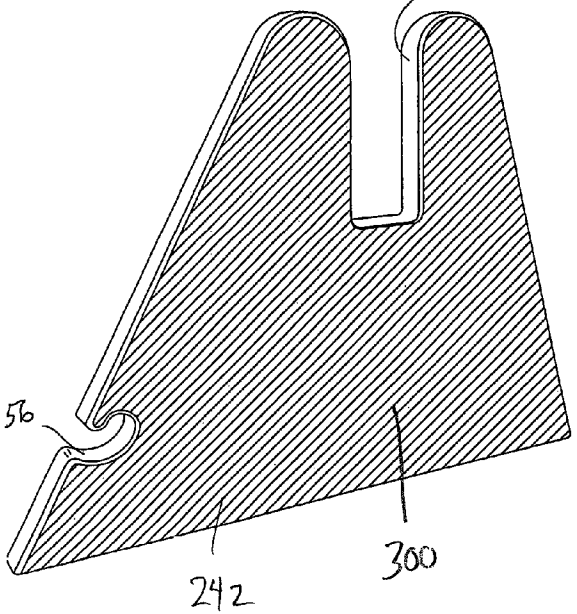

Referring to FIGS. 9 and 11A-11C, the coupling apparatus 201 includes a pair of slotted coupling supports 242*a*, 242*b* and a slotted coupling plate 244. Referring also to FIG. 14A, the coupling supports 242 include a slot 248 with a size S sufficient to accommodate the A1 and A3 panels and the coupling plate 244, as best seen in FIG. 11C. In this regard, the size S should be greater than or equal to the thickness of an A panel plus the thickness of the coupling plate 244. FIGS.

Figure 14C:
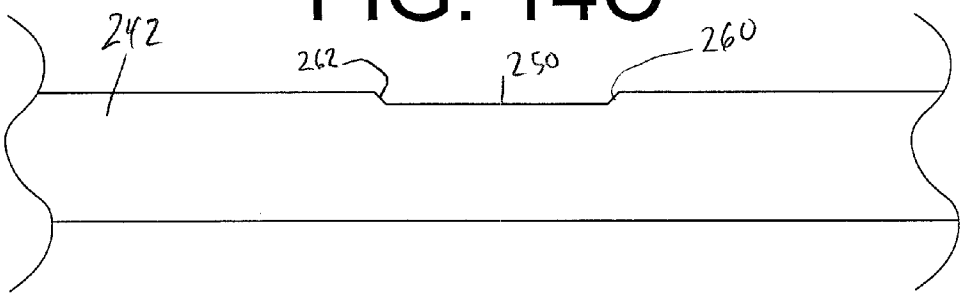
FIG. 14C is an enlarged fragmentary bottom elevational view of the coupling support.

14B and 14C show that a groove 250 is cut into a side surface 254 of the coupling support 242. FIG. 14C shows that the groove 250 includes a recessed surface 258 bounded on each side by surfaces 260, 262. One or both of the surfaces 260 and 262 may be beveled to facilitate interlocking of A slots therewith. Certain of the A slots capture the coupling supports 244 as shown.

Figure 15A:
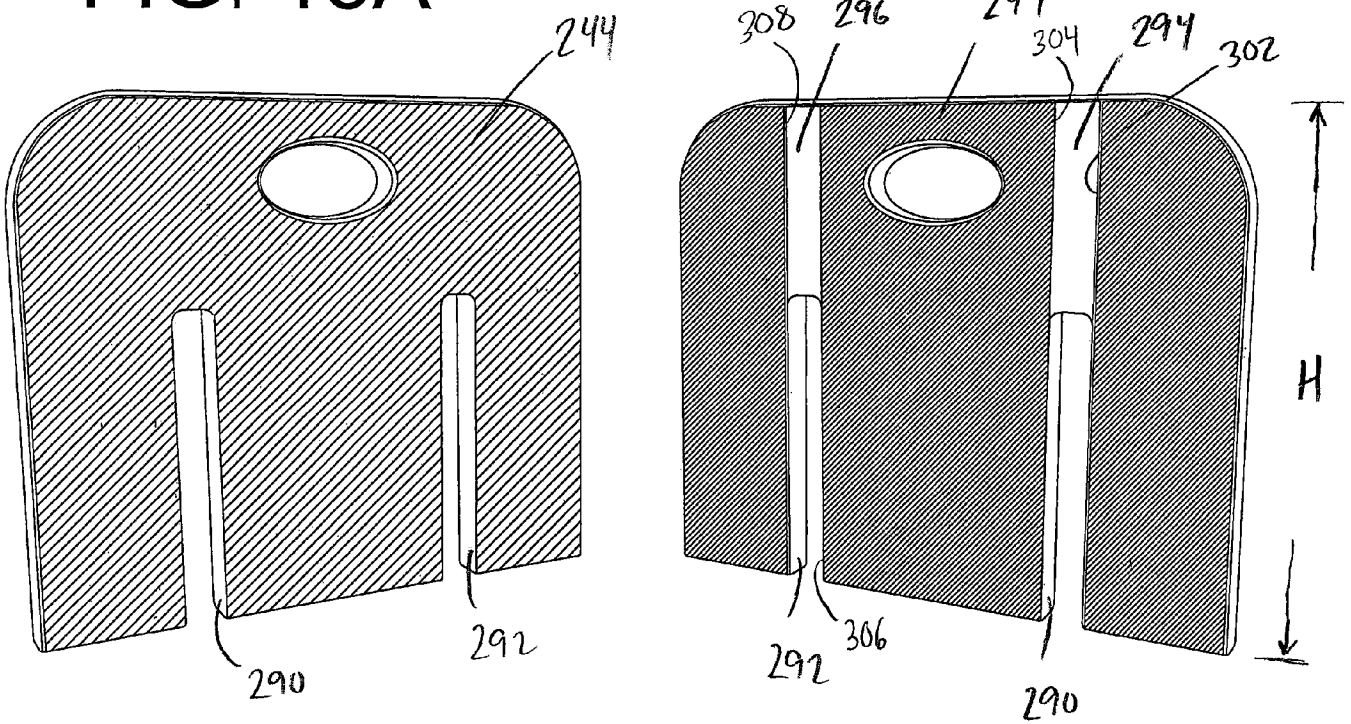
FIGS. 15A are isometric views of a coupling plate showing opposite sides thereof.
Figure 15B:
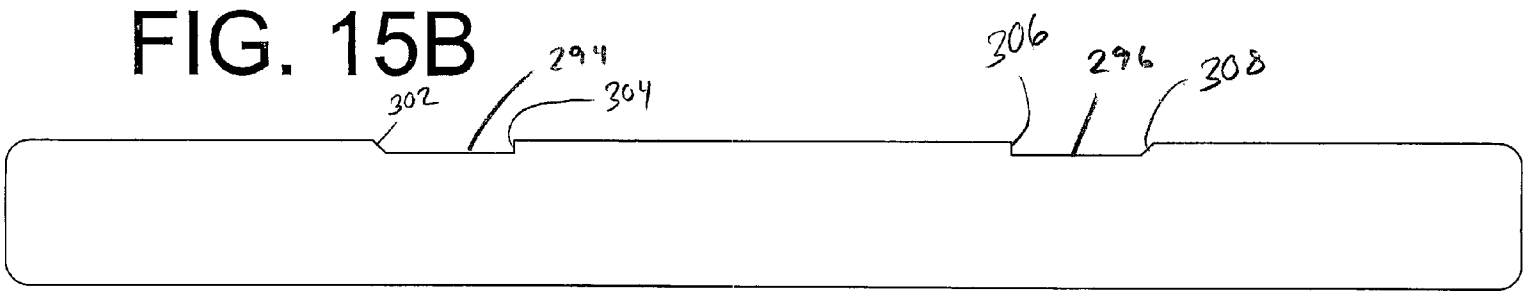
FIG. 15B is an enlarged bottom elevational view of the coupling plate.

Referring to FIGS. 15A and 15B, the coupling plate 244 includes slots 290, 292 and grooves 294, 296. The slots 290, 292 capture wall portions 300 of the coupling supports 242. The groove 294 is bounded on each side by opposed surfaces 302, 304, and the groove 296 is bounded on each side by opposed surfaces 306, 308. One or both of the opposed surfaces 302, 304 and one or both of the surfaces 306, 308 may be beveled along the entire height dimension H to facilitate interlocking.

Numerous modifications to the features described and shown are possible. Accordingly, the described and illustrated embodiments are to be construed as merely exemplary of the inventive concepts expressed herein and addressed in the appended claims.

I claim:

1. Panels for assembling a sandbox frame, comprising:

an elongate A panel and an elongate B panel, each panel having an end portion terminating in an end edge, the end edge oriented transverse to the length dimension of the panel;

a first cord receiving notch in the A panel end edge;

a second cord receiving notch in the B panel end edge;

a first elongate A slot proximate the A panel end portion, the first slot oriented transverse to the length dimension of the A panel; and a second elongate B slot proximate the B panel end portion, the second slot oriented transverse to the length dimension of the B panel;

a first groove in the A panel end portion, the first groove oriented transverse to the A panel length dimension, the groove recessed from a main surface of the A panel and defined by opposed groove walls wherein one of the groove walls is beveled;

wherein when the A and B panels are assembled:

the A panel slot interlocks with the B panel slot;

the A panel slot captures a B panel wall portion adjacent the B panel slot;

the B panel slot captures an A panel wall portion adjacent the A panel slot; and the A panel end portion and the B panel end portion intersect.

2. The panels of claim 1, wherein the A and B panel slots are oriented generally perpendicular to the length dimension of the panels.

3. The panels of claim 2, wherein the A slot is defined by opposed slot walls and at least one of the slot walls is beveled.

4. The panels of claim 3, wherein the beveled A slot wall is collinear with one of the beveled groove walls.

5. The panels of claim 4, wherein a first frame reinforcing strap connects the A panels and a second frame reinforcing strap connects the B panels.

6. The panels of claim 4, further comprising a tarp.

7. The panels of claim 6, further comprising sand.

8. The panels of claim 1, comprising a pair of A panels and a pair of B panels.

9. The panels of claim 1, comprising four B panels and two A panels.

10. The panels of claim 9, further comprising coupling apparatus.

11. The panels of claim 10, wherein the coupling apparatus includes a coupling support and one of the B panel slots interlocks with the coupling support, capturing a coupling support wall portion within the one B panel slot.

12. The panels of claim 11, wherein the coupling apparatus further includes a coupling plate having a coupling plate slot that captures a further coupling support wall portion.

13. The panels of claim 1, wherein the first notch is defined by generally opposed wall portions and at least one of the opposed wall portions extends in a direction transverse to the length dimension.

14. The panels of claim 1, wherein the at least one wall portion is curved.

15. The panels of claim 1, wherein the notches are lobe shaped.

16. The panels of claim 15, further comprising a tarp.

17. The sandbox of claim 1, further comprising a liner.

18. The sandbox of claim 1, further comprising an umbrella holder.

19. The sandbox of claim 1, further comprising a seat.

20. An assembled sandbox frame assembled from elongate interlocked slotted panels, comprising:

an A1 panel and an A2 panel and a B1 panel and a B2 panel;

first and second A1 panel ends and first and second A2 panel ends;

first and second B1 panel ends and first and second B2 panel ends wherein each of the A and B panel ends includes a tarp cord receiving notch;

a first corner defined by the first A1 panel end intersecting the first B1 panel end;

a second corner defined by the second A1 panel end intersecting the first B2 panel end;

a third corner defined by the first A2 panel end intersecting the second B1 panel end;

a fourth corner defined by the second A2 panel end intersecting the second B2 panel end;

a first A1 slot disposed proximate the first A1 panel end, the first A1 slot facing a first direction transverse to the long axis of the A1 panel;

a first B1 slot disposed proximate the first B1 panel end, the first B1 slot interlocked with the first A1 slot, the first B1 slot facing a second direction opposite to the first direction wherein a first wall portion of the B1 panel is captured within the first A1 slot and a second wall portion of the A1 panel is captured within the first B1 slot;

wherein the first wall portion includes a first groove defined by a first surface recessed from a main B1 panel surface and disposed between first and second opposed walls and wherein at least the first wall is beveled;

wherein the second wall portion includes a second groove defined by a second surface recessed from a main A1 panel surface and disposed between third and fourth opposed walls and wherein at least the third wall is beveled;

wherein the first beveled wall is in contact with the third beveled wall;

a second A1 slot interlocked with a first B2 slot of the B2 panel;

a first A2 slot interlocked with a second B2 slot of the B2 panel; and a second A2 slot interlocked with a second B1 slot of the B1 panel.

21. The assembled sandbox frame of claim 20, wherein the slots are oriented perpendicularly to the longitudinal dimension of the panels.

22. The assembled sandbox frame of claim 21, wherein the notches are lobe shaped.

* * * * *